US005322280A

United States Patent [19]

Wu

[11] Patent Number: 5,322,280

[45] Date of Patent: Jun. 21, 1994

[54] RACKET HANDLE

[75] Inventor: Chao-I Wu, Taichung Hsien, Taiwan

[73] Assignee: Jan Sports Products Corp., Taichung Hsien, Taiwan

[21] Appl. No.: 82,375

[22] Filed: Jun. 28, 1993

[51] Int. Cl.[5] ..... A63B 49/08

[52] U.S. Cl. ..... 273/73 J; 273/81 R

[58] Field of Search ..... 273/73 J, 73 R, 75, 273/81 R, 80.4

[56] References Cited

U.S. PATENT DOCUMENTS

| | | | |
|---|---|---|---|
| 4,101,125 | 7/1978 | Heath | 273/73 J X |
| 4,609,198 | 9/1986 | Tarr | 273/73 J |
| 4,660,832 | 4/1987 | Shomo | 273/73 J |
| 4,693,475 | 9/1987 | Keilhan | 273/73 J |
| 4,826,167 | 5/1989 | Lo | 273/73 J |
| 5,080,363 | 1/1992 | Soong | 273/73 J X |
| 5,197,732 | 3/1993 | Lanctot | 273/73 J |

FOREIGN PATENT DOCUMENTS

| | | | |
|---|---|---|---|
| 0519312 | 12/1992 | European Pat. Off. | 273/73 J |
| 2230458 | 10/1990 | United Kingdom | 273/73 J |
| 9200781 | 1/1992 | World Int. Prop. O. | 273/73 J |

*Primary Examiner*—William E. Stoll

*Attorney, Agent, or Firm*—Morton J. Rosenberg; David I. Klein

[57] ABSTRACT

A racket handle is provided which includes a handle member and a rod member forming a lower section of the racket frame. The handle member includes an outer pipe member and an inner pipe member defining a longitudinally extending closed annulus. The rod member is insertable within a bore formed by the inner pipe member and extends to a closed section or end of the inner pipe member. An elastic ring is mounted in the annulus between the inner and outer pipe member to absorb vibrational forces.

3 Claims, 3 Drawing Sheets

RACKET HANDLE

BACKGROUND OF THE INVENTION

The present invention relates to a shock absorbing or vibration-proof racket handle.

Prior art racket handles are generally formed of foamed plastic which have not damped vibration effectively. Prior art racket handles with damped vibration capabilities are generally complicated in overall structure. Referring to FIG. 1, there is illustrated a prior art racket handle 50 which is provided for vibration damping and is relatively simply structured. Such prior art racket handles are composed of an elastic ring 51 and a pipe 52. In such systems, the elastic ring 51 is installed within the pipe 52, however, it has been found difficult to assemble the racket handle with such a combined structure.

SUMMARY OF THE INVENTION

The present invention eliminates the disadvantages of the aforesaid prior art racket handles. It is an object of the present invention to provide a racket handle which is shock absorbing or vibration-proof and simple to assemble. It is another object of the present invention to provide a racket handle which couples to the racket securely.

The present invention relates to a racket handle which is composed of an ovoidly contoured frame and a handle having a particular structural contour for coupling at a first end section of the handle to the racket frame. The handle includes an outer pipe and an inner pipe extending coaxially within the outer pipe. The outer and inner pipes have an opening formed at the top and are formed each to the other at the first end section to form a closed annulus between the pipes. An elastic ring is installed in the annulus between the inner and outer pipes adjacent a second end section of the handle to aid in absorbing vibrational forces.

DETAILED DESCRIPTION OF THE PREFERRED EMBODIMENTS

Figure 1:
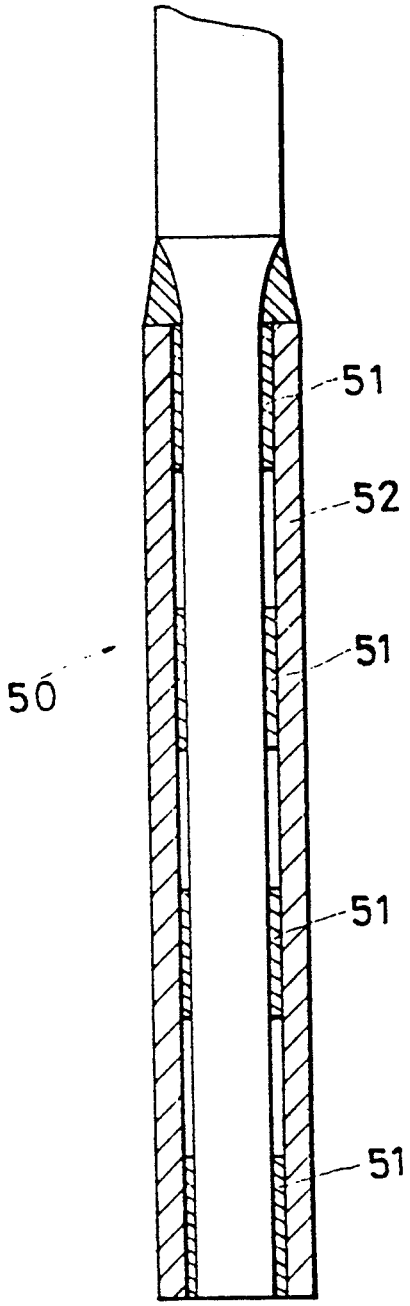
PRIOR ART FIG. 1
FIG. 1 is a sectional view of a racket handle in accordance with prior art constructions.
Figure 2:
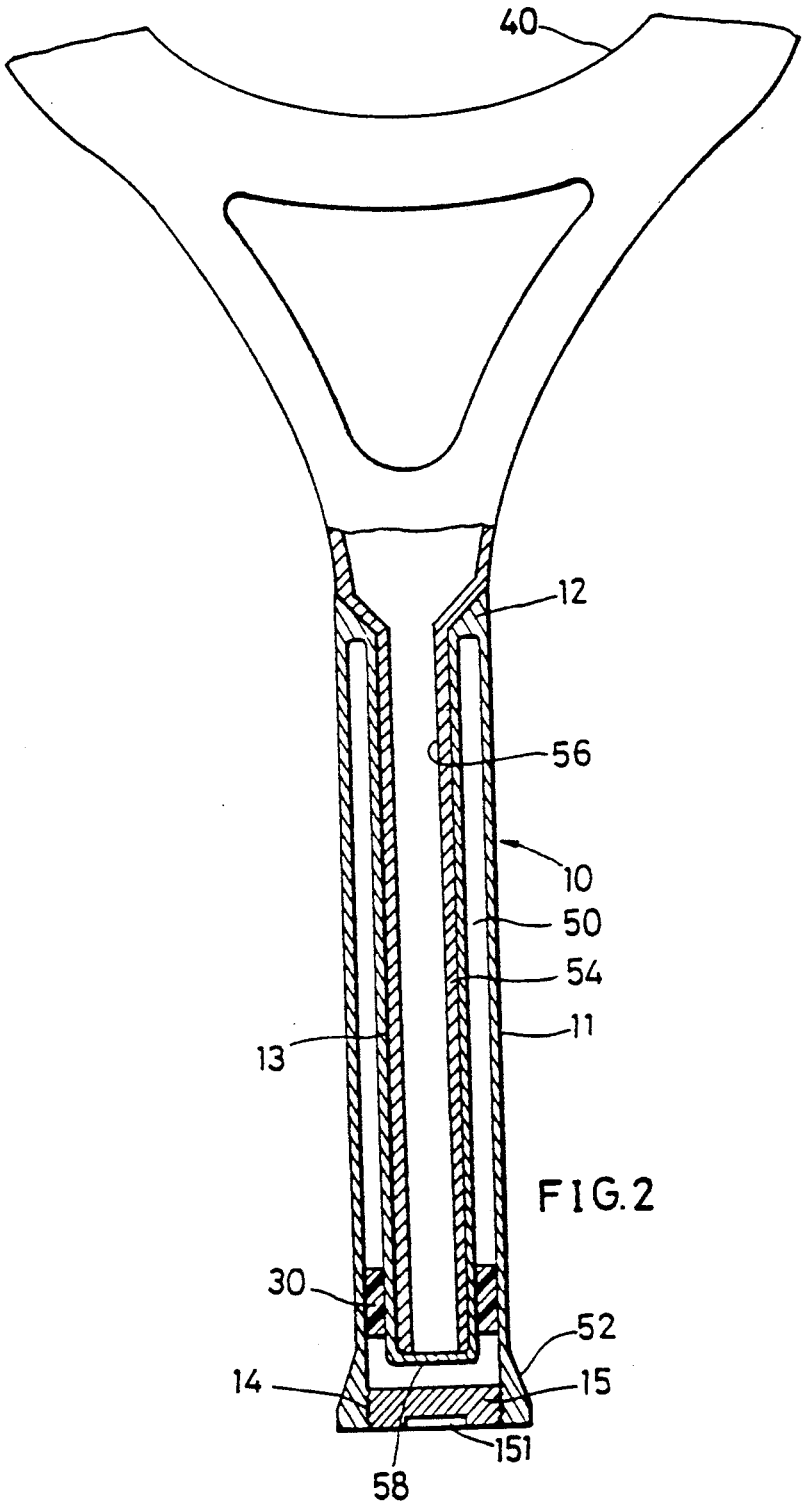
FIG. 2 is a sectional view of a racket handle of the present invention; and, FIG. 3 is an exploded view of the racket handle shown in FIG. 2.
Figure 3:
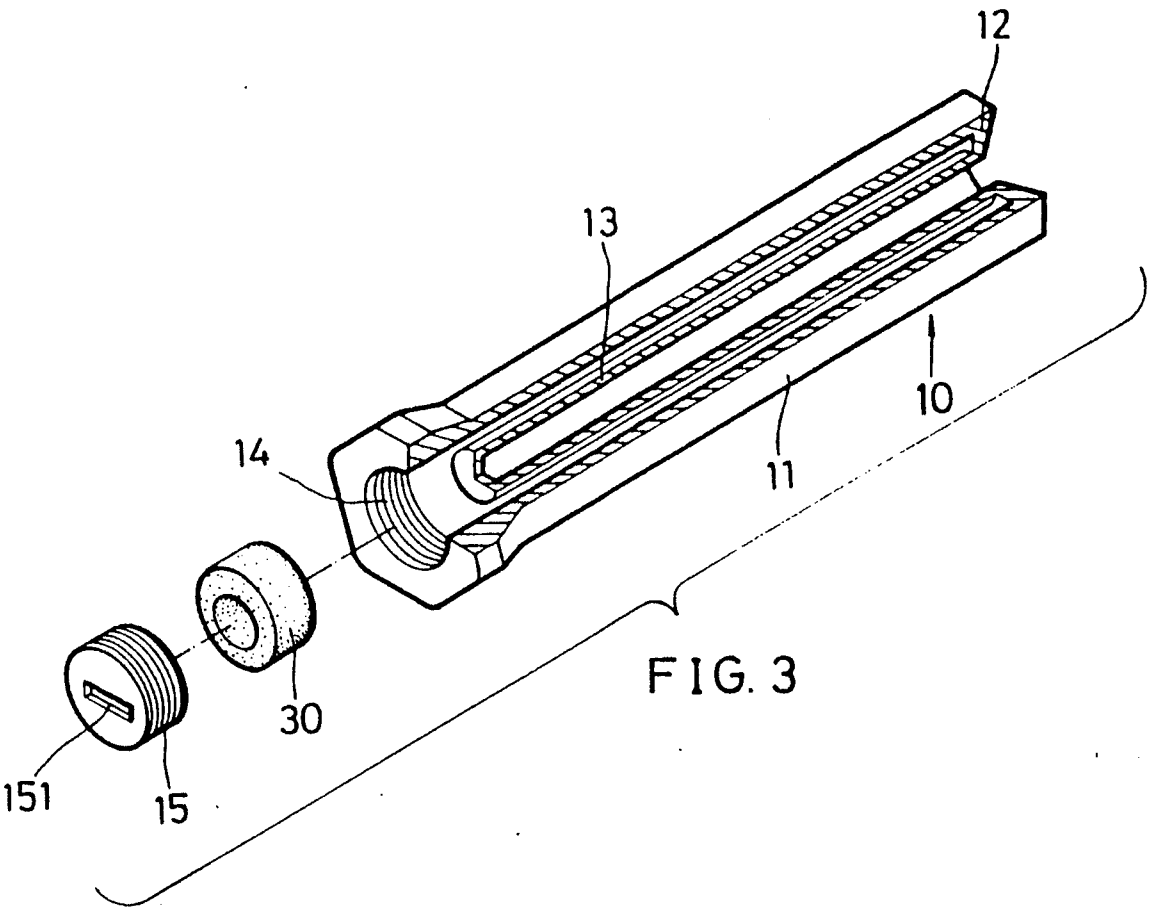

Referring now to FIGS. 2 and 3, there is shown a racket handle of the present invention concept. The racket handle comprises handle member 10 coupled to the racket frame 40.

The handle member 10 is formed of a foamed plastic and includes outer pipe 11 and inner pipe 13 forming a closed first end section 12 of the handle member 10 where the inner pipe 13 within the outer pipe 11 forms a closed end annulus 50. The downwardly or longitudinally extending inner pipe 13 is coupled to outer pipe 11 at first end section 12 as shown. An elastic ring 30 is mounted on the inner pipe 13 within annulus 50 for coupling the inner wall of the outer pipe 11 to the inner pipe 13 near the bottom end or second end section 52 of the handle member 10. There is a cover 15 installed in the bottom portion of outer pipe 11. The cover 15 is threaded for engagement will the screw thread 14 formed within the opening in order to enclose the bottom end or second end section 52 of the handle member 10. There is also a horizontal convex slot 151 formed within the bottom of the cover 15 for threadedly securing the cover 15 to handle member 10.

The racket frame 40 includes hollow rod member 54 which defines a hollow bore 56. Hollow rod member 54 forms a lower section of racket frame 40 as shown in FIG. 2. Rod member 54 is insertable within bore 56 and extends to lower closed end 58 of inner pipe member 13 as shown.

The theory of the racket handle of the present invention is similar to the lever principle. The racket frame 40 is the point of force application and first end section 12 is analogous to the fulcrum and the point of resistance is located at a connecting point between the bottom end of the inner pipe 13 and the elastic ring 30. Therefore, the application force applied to the elastic ring 30 and the racket frame 40 is diverted in opposing directions. Moreover, because the connecting part or hollow rod member 54 is mounted inside the inner pipe 13, such is completely covered by the inner pipe 13 and the application force transmitted from the racket 40 will be borne by the inner pipe 13.

However, the inner pipe 13 is hollow in structure. The elastic ring 30 is the mechanism which eliminates the application force and absorbs the vibrations so that the user can control the direction of the ball precisely. An adequate or predetermined volume of liquid can be injected into the annulus 50 between the inner pipe 13 and the outer pipe 11 to aid in absorbing the vibration. The elastic ring 30 can be easily installed and quickly replaced to same time in assembly.

While only a few embodiments of the present invention have been shown and described, it will be understood that various modifications and changes can be made without departing from the spirit and scope of the invention.

What is claimed is:

1. A racket handle in combination with a racket frame comprising:

(a) a longitudinally extending handle member having first and second opposing end sections, said handle member being formed of an outer pipe member and an inner pipe member forming a longitudinally extending annulus therebetween, said inner and outer pipe members being secured each to the other in one piece formation at said first end section forming a closed end annulus end, said inner pipe member having a closed end adjacent said handle second end section forming a longitudinally extending inner bore a hollow rod member inserted in the inner bore and forming a lower portion of said racket frame and secured to said handle member at said first end section; and, (b) an elastic ring member mounted in said longitudinally directed annulus adjacent said handle second end section.

2. The racket handle as recited in claim 1 including a cover member threadedly secured to said handle member at said handle second end section for forming a closed handle second end section.

3. The racket handle as recited in claim 1 wherein a predetermined volume of liquid is inserted into said annulus formed in said handle member.

* * * * *